United States Patent [19]

Müller et al.

[11] Patent Number: 4,763,719

[45] Date of Patent: Aug. 16, 1988

[54] APPARATUS FOR DISCONTINUOUS WITHDRAWING OF A CAST STRAND

[75] Inventors: Heinz Müller, Darien, Conn.; Thomas J. Nugent, New York, N.Y.

[73] Assignee: Voest-Alpine International Corporation, New York, N.Y.

[21] Appl. No.: 577,789

[22] Filed: Feb. 7, 1984

[51] Int. Cl.[4] ..... B22D 11/04; B22D 11/12

[52] U.S. Cl. ..... 164/478; 164/416; 164/442

[58] Field of Search ..... 164/478, 484, 490, 440, 164/442, 448, 416, 441

[56] References Cited

FOREIGN PATENT DOCUMENTS 1783032 9/1968 Fed. Rep. of Germany .
1583611 8/1970 Fed. Rep. of Germany .
2830002 1/1980 Fed. Rep. of Germany ..... 164/448
55-88957 7/1980 Japan ..... 164/416

*Primary Examiner*—Nicholas P. Godici
*Attorney, Agent, or Firm*—Horst M. Kasper

[57] ABSTRACT

An apparatus is provided for discontinuous withdrawing of a cast strand from a continuous casting mold. A drive roller frame is rotatably supported by a pedestal fixed as to spacial position. At least two drive rollers are rotatably supported by the drive roller frame and are disposed to press against the strand from opposite sides. A drive is connected to the drive rollers for driving the drive rollers. A reciprocating drive is connected to the drive roller frame for providing an oscillating pendulum motion to the drive roller frame around an axis supported by the pedestal.

21 Claims, 3 Drawing Sheets

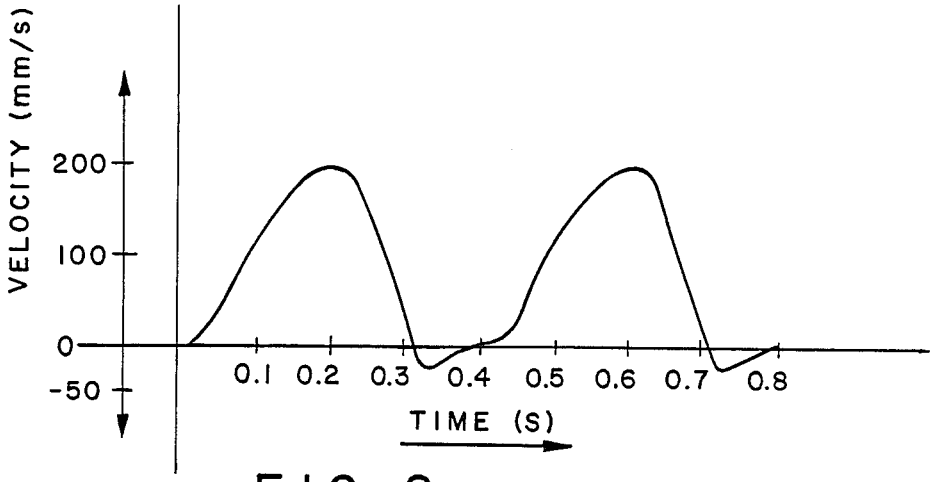
FIG. 2 WITHDRAWL SPEED CYCLE
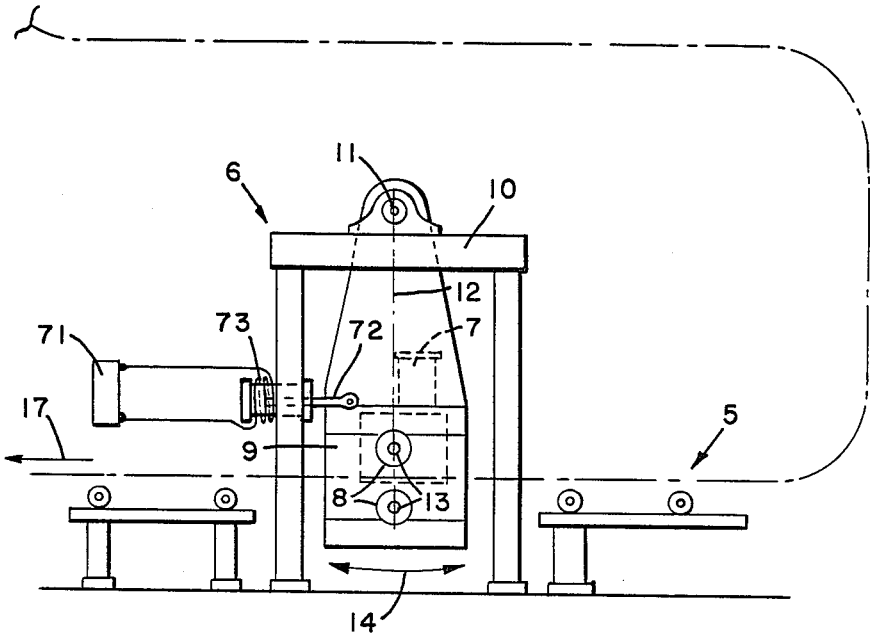
FIG. 3

APPARATUS FOR DISCONTINUOUS WITHDRAWING OF A CAST STRAND

BACKGROUND OF THE INVENTION

1. Field of the Invention

The present invention relates to an apparatus for discontinuous withdrawing of a cast strand from a continuous casting mold, in particular from a horizontal continuous casting mold having at least two drive rollers which can be pressed against two oppositely disposed strand sides and which drive rollers are driven by a drive.

2. Brief Description of the Background of the Invention Including Prior Art

It is known from (DE-AS 1 783 032) to withdraw the strand stepwise from the horizontal continuous casting mold with discontinuously driven rollers, where the continuous casting mold is disposed stationary during the casting, i.e., it does not oscillate. In contrast, the strand performs a discontinuous relative movement with respect to the horizontal continuous casting mold based on the forces transmitted to it by the drive rollers. The drive for discontinuously driven rollers is very expensive, in particular if the strand must not only perform a movement in the casting direction, but also a movement between the withdrawal steps of about a fraction of a length of a casting step against casting direction of the continuous casting mold. The length of the withdrawal steps must be variable in accordance with the solidification conditions, so that the control for the drive of the drive rollers is complex and expensive.

From the German Patent Application Laid Open DE-OS No. 1 583 611 it is known to drive the drive rollers of a horizontal continuous casting machine continuously and to periodically clamp the strand in a stationary position with a clamping device. During this clamping process the drive rollers roll along the surface of the strand and change their position with respect to the strand corresponding to this rolling, i.e., the axes of the drive rollers perform an oscillating movement. For this purpose the drive roller frame is mounted on a slide carriage, where the slide carrier is slidable and driven with a pressure medium cylinder. This construction is disadvantageous since a control device for clamping the strand with the clamping device must be provided in addition to the drive for the slide carriage and the drive for the drive rollers. The slide guides for the drive roller frame require particular attention, since slide guides in continuous casting mold installations tend to accumulate dirt and always represent an increased risk factor for the operating safety. Moreover, it is not possible to push back the strand against the casting direction between the withdrawal steps with the installation known from DE-OS No. 1,583,611 such a push-back, however is often required for the optimum formation of the strand shell.

SUMMARY OF THE INVENTION

1. Purposes of the Invention

It is an object of the invention to eliminate these disadvantages and difficulties by providing a device of the type described above, which requires only simple drive means, and which has an increased operating safety.

It is another object of the invention to enable a strand movement selectively over a wide range and in particular a periodical push back movement of the strand.

It is a further object of the invention to provide for a reliable method of casting a strand from a horizontal continuous casting mold.

These and other objects and advantages of the present invention will become evident from the description which follows.

2. Brief Description of the Invention

The present invention provides an apparatus for discontinuous withdrawing of a cast strand from a continuous casting mold which comprises a continuous casting mold providing a strand, a spacially fixed pedestal, a drive roller frame rotatably disposed at the fixed pedestal, at least two drive rollers rotatably supported by the drive roller frame and disposed to press against the strand from opposite sides, a drive connected to the drive rollers for driving the drive rollers, and a reciprocating drive connected to the drive roller frame for providing an oscillating pendulum motion to the drive roller frame around an axis supported by the pedestal.

The continuous casting mold can be a horizontal continuous casting mold. The pedestal can extend to above the position of the moving strand and the drive roller frame can hang on the pedestal. The swivel axis of the drive roller frame can be disposed in parallel to the axes of the drive rollers and is disposed about in the plane spanned by the axes of the two drive rollers disposed on opposite sides of the strand.

The drive of the swivel motion of the drive roller frame can be independent of the drive of the drive rollers. The reciprocating drive preferably is provided as a hydraulic drive or by pneumatic cylinders or by an electromagnetic coil.

There is also provided a method for discontinuous withdrawing of a cast strand which comprises providing a pedestal, swivel mounting on the pedestal a drive roller frame, supporting two drive rollers at the drive roller frame, withdrawing a strand from a continuous casting mold with the two drive rollers engaging and pressing against opposite sides of the strand, and a drive providing a linear motion with superimposed periodic oscillations to the strand.

The linear motion with superimposed oscillations can be generated by an eccentric drive mounted at the drive roller frame, or by a cam disk mounted at the drive roller frame. The linear motion with superimposed oscillations can be generated by providing to the drive rollers a substantially constant speed and by swiveling the drive roller frame around an axis at the pedestal with a reciprocating drive. The distance from the continuous casting mold to the average contact point of the rollers with the strand is at least about two times the distance between the moving strand and the swivel axis of the frame. The motion of the strand can be such that the strand is resting or moving backward for less than 10 percent of the time of the oscillation cycle. The drive rollers can be spring- loaded against the cast strand. The pedestal can extend above the moving strand, the drive roller frame can hang at an axle supported by the pedestal, and the axle of the drive roller frame can be disposed in parallel to the drive roller axis. The drive of the drive rollers and the swivel drive need not to be independent; they can be combined into a single drive unit such as a d.c. motor or a hydraulic drive. In this case the drive roller drive is preferably mounted at the drive roller frame and includes a cam disk, which runs against a spacially fixed guide.

The novel features which are considered as characteristic for the invention are set forth in the appended claims. The invention itself, however, both as to its construction and its method of operation, together with additional objectives and advantages thereof, will be best understood from the following description of specific embodiments when read in connection with the accompanying drawing.

BRIEF DESCRIPTION OF THE DRAWING

In the accompanying drawing, in which is shown one of the various possible embodiments of the present invention:

FIG. 2 is a schematic diagram showing a curve representing the withdrawal speed cycle.

FIG. 3 is a schematic view like that of FIG. 1, however including a solenoid drive.

DESCRIPTION OF INVENTION AND PREFERRED EMBODIMENTS

Figure 1:
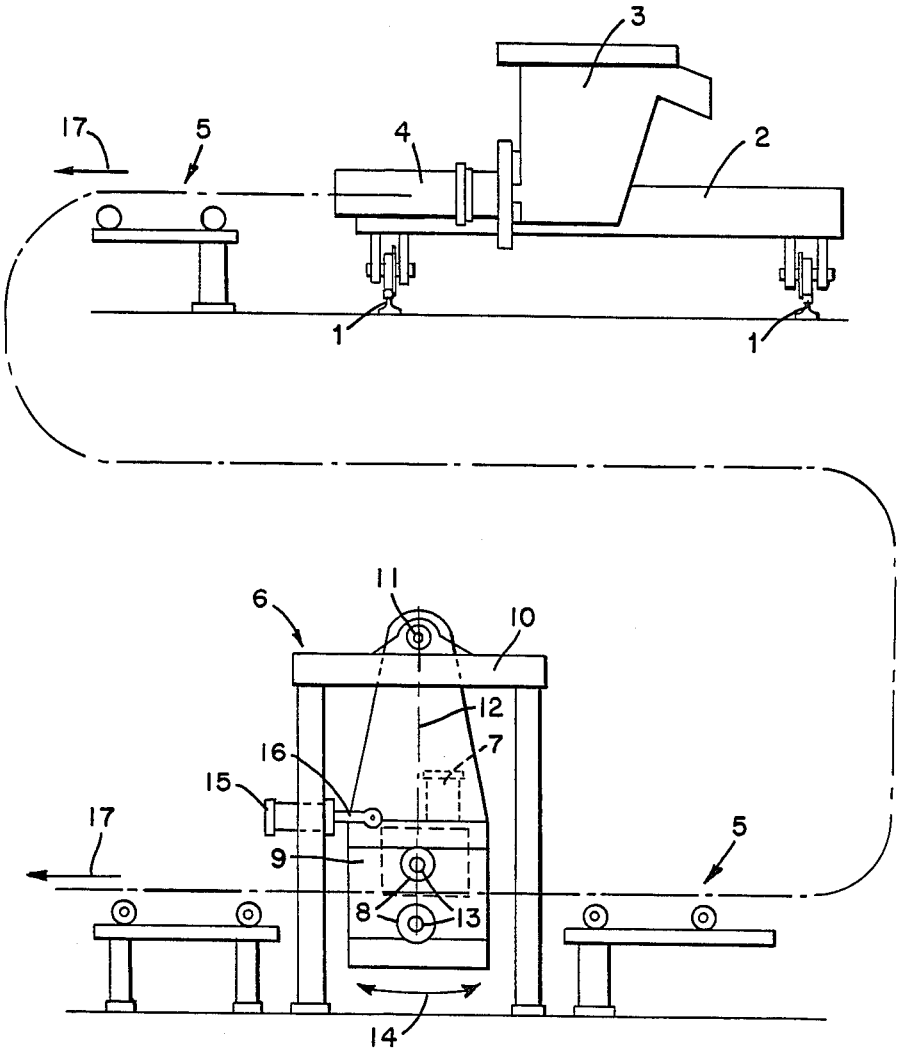
FIG. 1 is a schematic side elevational view of the casting apparatus of the present invention.

In accordance with the present invention there is provided an apparatus for a discontinuous withdrawing of a continuous cast strand from a continuous casting mold which comprises a drive roller frame pivotably mounted around a pivot axis on a stationary support and preferably tiltable into a cyclic movement around the pivot axis by means of a pivot drive. In particular a horizontal casting machine with at least two opposite drive rollers is provided, which drive rollers press on opposite sides of the strand and which drive rollers (8) are driven by means of a drive (7) and which are rotatably mounted on a drive roller frame (9). The drive roller frame (9) is pivotably mounted around a pivot axis (11) on a stationary support (10) and can be moved with an oscillating movement (14) around the pivot axis (11) by means of a pivot drive (15).

The distance from the continuous casting mold to the average contact point of the rollers with the strand is at least about two times the distance between the moving strand and the swivel axis of the frame.

The support (10) can be designed in such a manner that it extends above the strand and that the drive roller frame (9) is mounted on the support (10) in a suspended manner. This construction has the advantage that the pivot mounting of the drive roller frame is not affected by scale dropping from the strand, dropping cooling agent etc.

The pivot axis (11) can be directed parallel to the axis (13) of the drive rollers (8) and at about the plane (12) which is formed by the axis (13) of the two oppositely disposed drive rollers (8). The pivot drive (15) can be independent from the drive (7) of the drive rollers (8). The pivot drive (15) can be designed as a hydraulic or pneumatic cylinder, or as a solenoid. Preferably, two drives are required, but the drive for the cyclic movement and the drive for the drive rollers can be combined. In this case, the drive roller drive is mounted on the drive roller frame (9) and provided with an eccentric drive or a cam disk which runs against a stationary guide; this drive is advantageously a d.c. motor or a hydromotor.

A tundish 3 for receiving a melt is mounted on a carriage 2 horizontally movable on tracks 1. The outlet opening of the tundish 3 discharges into an open-ended mold 4 whose longitudinal axis is horizontally disposed. The mold is fed with molten metal. The hot continuous cast strand, billet or slab, which are not shown in the drawing, and which discharge from the continuous casting mold, 4 are conveyed via a horizontally disposed roller table 5 and to a withdrawing device which is generally designated with numeral reference 6.

The withdrawing device 6 is provided with two oppositely disposed drive rollers 8 which are driven by means of a drive 7 and which can be pressed against opposite sides of the strand. These drive rollers are rotatably mounted in a drive roller frame 9. The drive rollers can have a radius of from about 5 centimeters to about 50 centimeters and preferably their radius is from about 10 to 30 centimeters. The clamping force exerted by the drive rollers on the strand can be from about 1,000 Newton to about 100,000 Newton and is preferably from about 5,000 Newton to 50,000 Newton. The pulling force exerted by the rollers to withdraw the strand can be from about 1,000 to 200,000 Newton and preferably from about 2,000 to 100,000 Newton. The drive roller frame 9 is pivotably mounted on a support stand 10 which represents a pedestal which extends above the strand. The pivot axis 11 is disposed in parallel with respect to the axis of the drive rollers 8 and also at about the plane 12 formed by the axis 13 of the drive rollers. The distance of the pivot axis to the position of the strand passing through the rollers can be from about 1 meter to 3 meters.

In the embodiment illustrated in the drawing, a hydraulic cylinder 15 is provided as a drive for the cycle movement to be performed by the drive roller frame 9 in the direction of the double arrow 14. This hydraulic cylinder is mounted on the stationary support 10, on the one hand, and mounted with its piston 16 on the drive roller frame 9 on the other hand.

In casting direction 17 behind the withdrawal device 6 follows a cutting unit for cutting the strand. This cutting unit is not illustrated in the drawing.

The operation of the apparatus is as follows:

The drive rollers 8, which rotate with a constant angular speed, are in constant contact with the surface of the hot strand. By reciprocally oscillating in the direction of the double arrow 14, the strand performs an oscillating withdrawal movement despite the drive rollers 8 which rotate with a constant angular speed, that is, in accordance with the movement resulting from the two superimposing movements, namely the oscillating movement of the drive roller frame and the rotating movement of the drive rollers. The average advance speed of the strand can be from about 1 to 6 meter per minute. The number of cycles in advancing and slowing down the strand can be from about 10 to 250 per minute and is preferably from about 25 to 150 per minute.

The invention is not limited to the exemplified embodiment illustrated in the drawing, but may be modified in different respects. As a drive for withdrawing the strand slow turning motors like "torque"-direct current-or hydromotors are being used, for example. As drives for the oscillation, d.c. motor or hydromotors operating over cams or (double-) eccentrics or pneumatic cylinders are also suitable. Of particular advantage is an electromagnetic coil whose flexibility with respect to controllable oscillation cycles and frequencies is very large. In addition, a coil whose armature is coupled to the oscillating drive roller frame is mounted on support 10 in a stationary manner with respect to the continuous casting mold.

A particularly simple embodiment is constructed as follows: The drive is mounted directly on the drive roller and also affects the "oscillation" of the drive roller frame and thereby the strand by means of an eccentric drive or a cam disk which runs against a guide, which is stationary with respect to the strand. According to this embodiment only one drive unit is required.

FIG. 3 illustrates the embodiment of FIG. 1, however with a solenoid drive. A controlled power supply 71 powers a solenoid coil 73, wherein a permanent magnet plunger 72, moves depending on the current direction in the coil and the magnetic field generated thereby.

Figure 4:
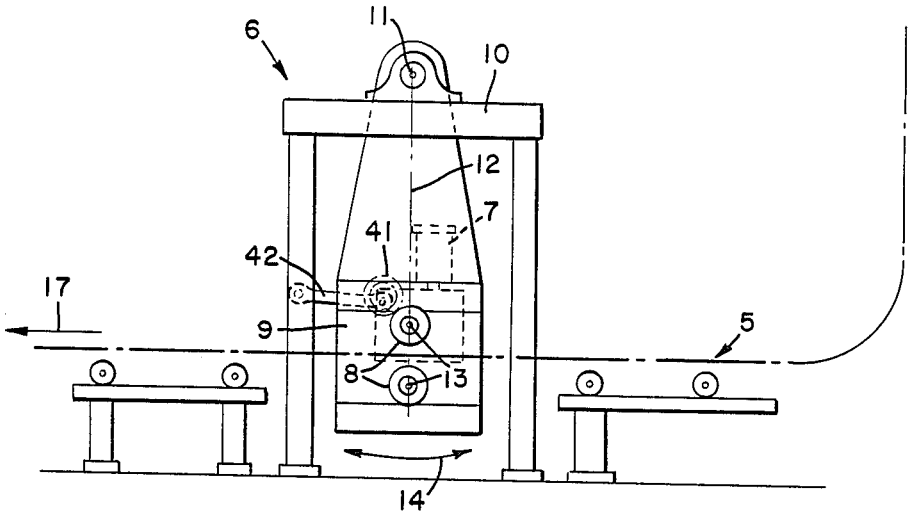
FIG. 4 is a schematic view like that of FIG. 1, however including a cam disk moving relative to a stationary guide and spring loaded drive rollers.

FIG. 4 illustrates an embodiment where the drive 7 of the drive rollers 8 is also employed as a tilting drive for providing motion to the drive roller frame 9. The drive of the drive rollers, which can be provided as a direct current or as a hydraulic drive motor 7 drives in addition to the drive rollers 8 via a gear wheel 41 a connecting rod 42, which on the one hand is hinged to the gear wheel 41 of the drive roller frame 9 and which on the other hand is hinged to the spacially fixed support stand 10. Thus upon actuation of the drive rollers with the drive 7, the same drive 7 places also the drive roller frame 9 in an oscillating motion relative to the spacially fixed stand 10.

Figure 5:
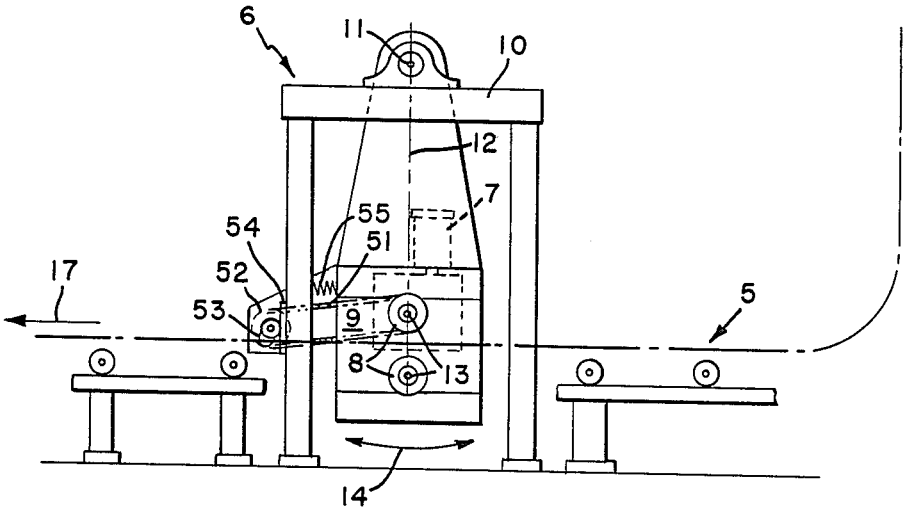
FIG. 5 is a schematic view of an eccentric drive.

The embodiment of FIG. 5 illustrates the driving of a gear wheel 52 by the drive 7 of the drive rollers 8 via a drive chain 51. A cam disk 53 is attached to the gear wheel 52. This cam disk 53 runs against a spacially fixed guide 54, which is attached to the spacially fixed support stand 10. In order to avoid a lifting off of the cam disk 53 from the spacially fixed guide 54, a compression spring 55 is incorporated between the drive roller frame 9 and the support stand 10.

It will be understood that each of the elements described above, or two or more together, may also find a useful application in other types of casting system configurations and metal melt processing procedures differing from the types described above.

While the invention has been illustrated and described as embodied in the context of an apparatus for discontinuous withdrawing of a cast strand it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for discontinuous withdrawing of a cast strand from a continuous casting mold comprising a continuous casting mold;

a spacially fixed pedestal;

a drive roller frame swivelably disposed on the fixed pedestal;

at least two drive rollers rotatably supported by the drive roller frame and disposed to press against the strand from opposite sides;

a drive connected to the drive rollers for driving the drive rollers; and a reciprocating drive connected to the drive roller frame for providing an oscillating pendulum motion to the drive roller frame around an axis supported by the pedestal.

2. The apparatus for discontinuous withdrawing of a cast strand according to claim 1 wherein the continuous casting mold is a horizontal continuous casting mold.

3. The apparatus for discontinuous withdrawing of a cast strand according to claim 1 wherein the pedestal extends to above the position of the moving strand and where the drive roller frame hangs on the pedestal.

4. The apparatus for discontinuous withdrawing of a cast strand according to claim 1 wherein the swivel axis of the drive rollers frame is disposed in parallel to the axes of the drive rollers and is disposed substantially in the plane spanned by the axes of the two drive rollers disposed on opposite sides of the strand.

5. The apparatus for discontinuous withdrawing of a cast strand according to claim 1 wherein the drive of the swivel motion of the drive roller frame is independent of the drive of the drive rollers.

6. The apparatus for discontinuous withdrawing of a cast strand according to claim 1 wherein the reciprocating drive is provided by at least one hydraulic drive.

7. The apparatus for discontinuous withdrawing of a cast strand according to claim 1 wherein the reciprocating drive is provided by at least one pneumatic cylinder.

8. The apparatus for discontinuous withdrawing of a cast strand according to claim 1 wherein the reciprocating drive is provided by at least one electromagnetic coil or solenoid.

9. The apparatus for discontinuous withdrawing of a cast strand according to claim 1 wherein the drive of the drive rollers is employed in addition as a swivel drive.

10. The apparatus for discontinuous withdrawing of a cast strand according to claim 9 wherein the drive of the drive rollers is provided by at least one d.c. motor.

11. The apparatus for discontinuous withdrawing of a casting strand according to claim 9 wherein the drive of the drive rollers is provided as a hydraulic drive.

12. The apparatus for discontinuous withdrawing of a cast strand according to claim 9 wherein the drive of the drive rollers is mounted at the drive roller frame and includes at least one eccentric drive, which performs a motion relative to a spacially fixed guide.

13. The apparatus for discontinuous withdrawing of a cast strand according to claim 9 wherein the drive roller drive is mounted at the drive roller frame and includes at least one cam disk, which runs against a spacially fixed guide.

14. A method for discontinuous withdrawing of a cast strand comprising providing a pedestal;

swivel mounting a drive roller frame on the pedestal;

supporting two drive rollers at the drive roller frame;

withdrawing a strand from a continuous casting mold with the two drive rollers engaging and pressing against opposite sides of the strand; and driving said pedestal and thereby providing a linear motion with superimposed periodic oscillations to the strand.

15. The method for discontinuous withdrawing of a cast strand according to claim 14 wherein the linear motion with superimposed oscillations is generated by at least one eccentric drive mounted at the drive roller frame.

16. The method for discontinuous withdrawing of a cast strand according to claim 14 wherein the linear motion with superimposed oscillations is generated by at least one cam disk mounted to the drive roller frame.

17. The method for discontinuous withdrawing of a cast strand according to claim 14 wherein the linear motion with superimposed oscillations is generated by providing to the drive rollers a substantially constant speed and by swivelling the drive roller frame around an axis at the pedestal with a reciprocating drive.

18. The method of discontinuous withdrawing of a cast strand according to claim 17 wherein the distance from the continuous casting mold to the average contact point of the rollers with the strand is at least about two times the distance between the moving strand and the swivel axis of the frame.

19. The method for discontinuous withdrawing of a cast strand according to claim 14 wherein the motion of the strand is such that the strand is resting or moving backward for less than 25 percent of the time of the oscillation cycle.

20. The method for discontinuous withdrawing of a cast strand according to claim 14 further comprising spring loading the drive rollers against the cast strand.

21. The method for discontinuous withdrawing of a cast strand according to claim 14 further comprising providing the pedestal extending above the moving strand;

hanging the drive roller frame at an axle supported by the pedestal; and disposing the axle of the drive roller frame in parallel to the drive roller axis.

* * * * *